US010312000B2

(12) United States Patent
Good

(10) Patent No.: US 10,312,000 B2
(45) Date of Patent: Jun. 4, 2019

(54) HEAT DISSIPATING CABLE JACKET

(71) Applicant: NEXANS, Paris (FR)

(72) Inventor: Paul Michael Good, New Holland, PA (US)

(73) Assignee: NEXANS, Courbevoie (FR)

( * ) Notice: Subject to any disclaimer, the term of this patent is extended or adjusted under 35 U.S.C. 154(b) by 0 days.

(21) Appl. No.: 15/204,583

(22) Filed: Jul. 7, 2016

(65) Prior Publication Data

US 2018/0012680 A1 Jan. 11, 2018

(51) Int. Cl.

*H01B 7/18* (2006.01)
*H01B 7/42* (2006.01)
*H01B 11/02* (2006.01)

(52) U.S. Cl.

CPC ..... *H01B 7/421* (2013.01); *H01B 11/02* (2013.01); *H01B 7/184* (2013.01)

(58) Field of Classification Search

CPC ..... H01B 7/421; H01B 9/003; H01B 11/02; H01B 11/1834; H01B 7/42; H01B 7/426; H01B 7/184

USPC ..... 174/113 R, 95, 102 D, 117 AS, 113 C

See application file for complete search history.

(56) References Cited

U.S. PATENT DOCUMENTS 5,829,485 A * 11/1998 Fatato ..... B60R 16/0215 138/110
2002/0008962 A1 1/2002 Hutchison et al.
2004/0055771 A1 3/2004 Wiekhorst et al.
2005/0092514 A1 5/2005 Kenny et al.
2006/0032660 A1* 2/2006 Parke ..... H01B 7/184 174/113 R
2006/0180329 A1 8/2006 Caveney
2006/0237217 A1 10/2006 Glew
2007/0066124 A1* 3/2007 Park ..... H01B 11/06 439/418
2007/0277996 A1 12/2007 Caveney et al.
2008/0164049 A1 7/2008 Vexter et al.
2009/0096126 A1* 4/2009 Baverel ..... B29C 47/126 264/146
2009/0233052 A1 9/2009 Thuot et al.
2010/0181093 A1 7/2010 Wiekhorst et al.
2013/0056240 A1* 3/2013 Kawai ..... H02G 3/0481 174/124 R

FOREIGN PATENT DOCUMENTS

EP 2693449 2/2014

* cited by examiner

*Primary Examiner* — Steven T Sawyer

(74) *Attorney, Agent, or Firm* — Sofer & Haroun, LLP

(57) ABSTRACT

A cable is provided, configured for tandem communication and power transmission. The cable has a plurality of twisted pair conductors and a jacket surrounding said twisted pair conductors. The jacket includes a plurality of either ridges, valleys or both, disposed substantially perpendicular to the longitudinal axis of the cable, the ridges and/or valleys are dimensioned and spaced apart in a manner sufficient to create an air passage when the cable is arranged adjacent to and abutting other cables.

18 Claims, 6 Drawing Sheets

HEAT DISSIPATING CABLE JACKET

BACKGROUND

Field of the Invention

This invention relates to a cable jacket. More particularly, this invention relates to a novel cable jacket design that helps dissipate heat from the cable.

Description of Related Art

A recent development in communications cabling is the tandem delivery of power and data signals through a single cable. Although not always the case, a typical arrangement would utilize a normal LAN (Local Area Network) twisted pair cable, usually having four twisted pairs of insulated copper conductors therein. In normal LAN operations all four pairs are for data communication. However, in tandem power/data applications some of the pairs are dedicated to data communications but one or more of the pairs can be used to deliver power though the same cable. In some cases, a twisted pair carrying data can also carry power at the same time as the data transmits via AC (alternating current) and the power transmits via DC (direct current) so it is possible to split the power and data signals from one another as needed. Such data/power tandem arrangements can be used for example with security cameras or VoIP phones which require a small amount of power as well as data communication.

Initially, IEEE (Institute for Electrical and Electronics Engineers) adopted the 802.3af standard for Power over Ethernet (Or PoE) which has been widely accepted in the industry setting the relevant parameters, such as wattage, negotiation parameters/routines, DC loop resistance etc . . . , for delivering power in tandem with data. The total amount of power that can be delivered under this standard is 12.95 W which is adequate for such basic applications such as the standard VoIP phones and security cameras noted above.

However, growing lists of features on devices that are connected and powered with tandem power/data cables as well as new communication equipment that likewise can make use of the tandem power/data through LAN cables, has necessitated even more power throughput allowance. IEEE 802.8at is an updated standard that allows for an increase to 25.5 W power (PoE+) to be delivered through such tandem cables. Another even newer standard is IEEE 802.3bt that sets the parameters for using all four twisted pairs to simultaneously send data and power. In the conditions according to this newer standard cables sending both data and power in some cases will be delivering as much as 100 Watts. These high rates of power transmission can lead to the operating temperatures of the cable exceeding its maximum allowable operating temperature according to the cables own heat tolerance thresholds. This is especially true when large numbers of cables are installed together or bundled adjacent to and abutting one another. With this increase in power throughput through one or more of the twisted pairs of a LAN cable, there is a corresponding increase in heat that needs to be dissipated from the cables to the environment. This leads to concerns about fire safety and data transmission performance and ultimately limits the number of such tandem operation cables that can occupy a single pathway or be arranged next to one another in order to stay within the range of safe operating temperatures. For example the NFPA (National Fire Protection Association) 70 standard, setting the National Electrical Code covering these cables, requires that the cables do not exceed their listed maximum operating temperature which is typically 60 C.

As shown in prior art FIGS. 1 and 2, typical LAN cables are constructed having four insulated twisted pairs, an optional cross filler (depending on the data signal requirements), and an outer jacket enclosing the cable. The prior jackets for twisted-pair cables do not take heat dissipation into consideration, and therefore, are not optimized for supporting power provided through one or more of its twisted pairs. Standard cable jackets such as those shown in FIGS. 1 and 2 possess an outer surface that generally maintains an equal distance from the center of the cable for the entire length of the cable. When multiple LAN cables are placed together they touch along their entire longitudinal axis (longest axis) and entrap the heat generated by the power conductors as conductive heat transfer is less efficient than convective heat transfer.

OBJECTS AND SUMMARY

The present arrangement overcomes the drawback by providing a novel design for the outer surface of a LAN cable jacket, intended to be used for tandem power/data signaling applications, that allows for better air flow around the cables.

In one embodiment, a series of ridges or valleys are disposed, circumferentially or helically around the outer surface of the cable jacket, such ridges or valleys spaced apart from one another over the length of the cable. Such structures, either ridges or valleys generate an air gap between adjacent cables allowing air to flow between, allowing the heat released from the one or more powered twisted pairs to escape more easily through the outer surface of the jacket and to generate a convection air flow upward around and in between the cables.

This design allows installers and end-users to install larger numbers of LAN cables, intended for tandem power/data communication, within a single pathway without exceeding the allowable temperature rise and thus the maximum operating temperature.

To this end a cable is provided, configured for tandem communication and power transmission. The cable has a plurality of twisted pair conductors and a jacket surrounding said twisted pair conductors. The jacket includes a plurality of either ridges, valleys or both, disposed substantially perpendicular to the longitudinal axis of the cable, the ridges and/or valleys are dimensioned and spaced apart in a manner sufficient to create an air passage when the cable is arranged adjacent to and abutting other cables.

BRIEF DESCRIPTION OF THE DRAWINGS

The present invention can be best understood through the following description and accompanying drawings, wherein.

DETAILED DESCRIPTION

Figure 1:
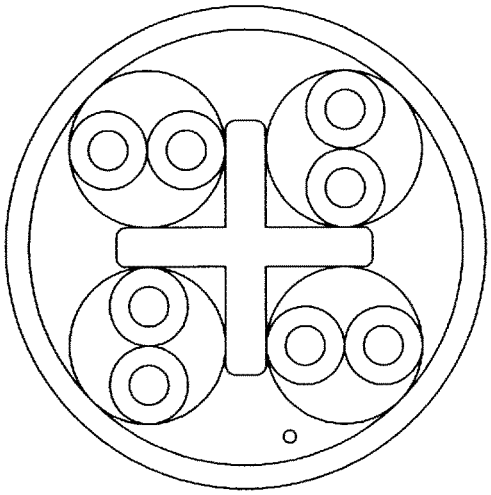
FIG. 1 (PRIOR ART)
FIGS. 1 and 2 illustrate prior art LAN cables, capable of supporting tandem power and data communications in the same cable.
Figure 2:
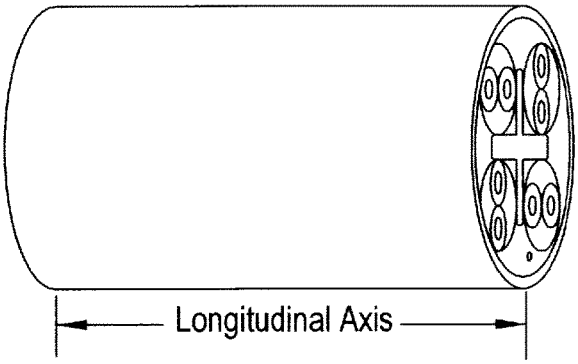
FIG. 2 (PRIOR ART)
Figure 3:
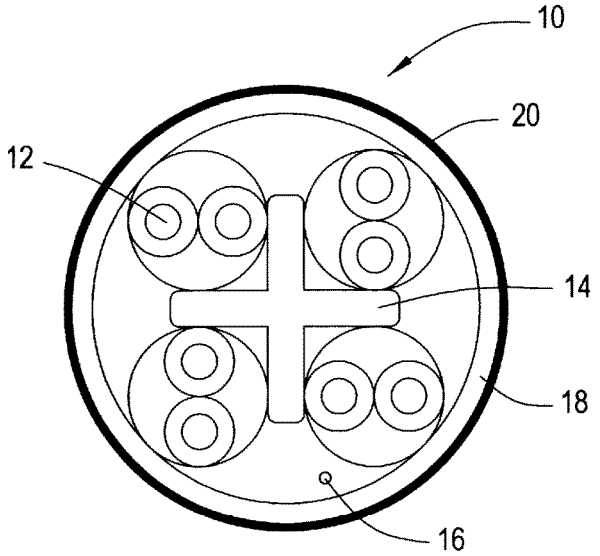
FIGS. 3 and 4 illustrate a LAN cable, capable of supporting tandem power and data communications in the same cable, with a jacket according to one embodiment.
Figure 4:
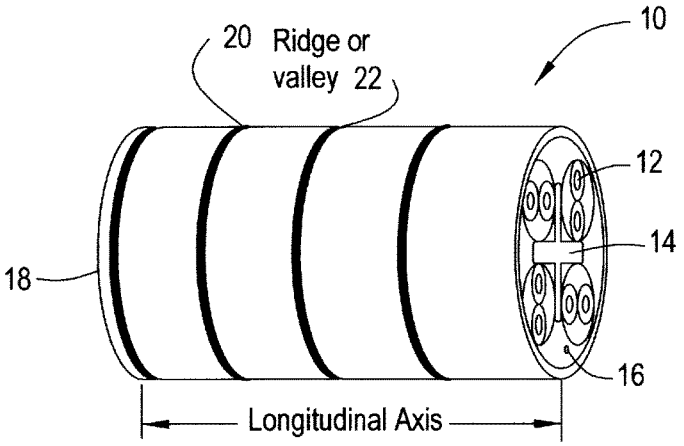

In one embodiment of the present arrangement, FIGS. 3 and 4 illustrate a LAN cable according to one embodiment. Cable 10 has four twisted pairs 12, each made from two twisted insulated copper conductors, a cross filler 14, a drain wire 16 and a jacket 18. It is understood that that this form of tandem power/data communications cable is being shown for illustration purposes only, but is not intended to limit the scope of the application. The applicable heat dissipating features as described below can be applied to any tandem power/data communication cable arrangement.

As illustrated more clearly in FIG. 4, jacket 18 is constructed from any suitable polymer such as PVC (PolyVinylChloride) or PE (PolyEthylene) etc. . . . , but unlike typical jackets with smooth outer surfaces, jacket 18 has a series of circumferentially disposed ridges 20 and/or valleys 22, angled substantially perpendicular to the longitudinal axis of the cable.

Figure 5:
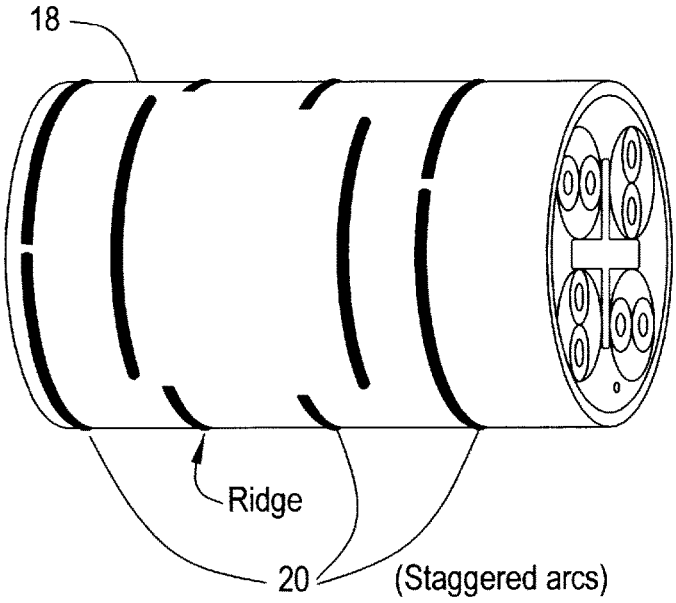
FIG. 5 illustrates a LAN cable having a plurality of ridges disposed on the outer circumference of the jacket, according to one embodiment.
Figure 6:
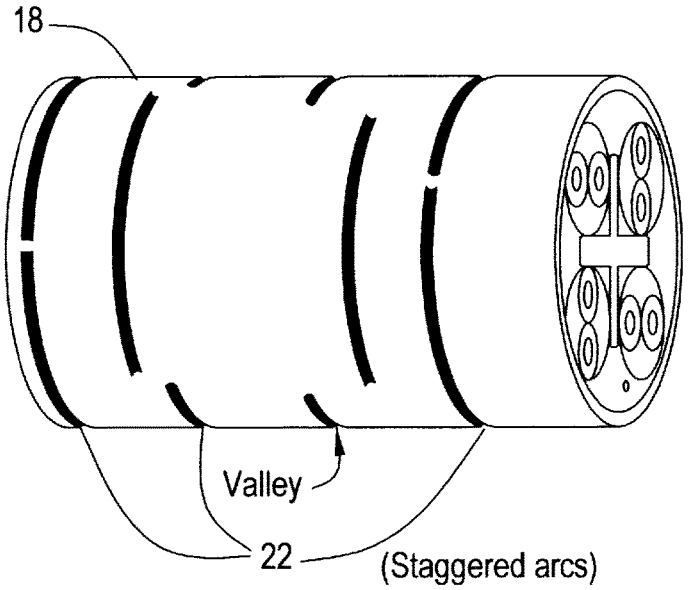
FIG. 6 illustrates a LAN cable having a plurality of valleys disposed on the outer circumference of the jacket, according to one embodiment.
Figure 7:
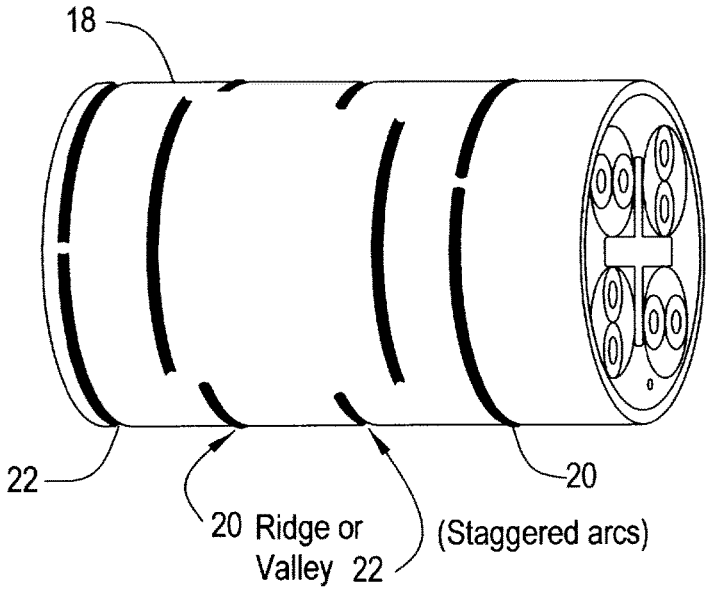
FIG. 7 illustrates a LAN cable having a plurality of ridges and valleys disposed on the outer circumference of the jacket, according to one embodiment.

In the embodiment shown in FIG. 4 either ridges 20 or valleys 22 are shown as complete rings around the entire outer circumference of jacket 18. FIG. 5 shows jacket 18 in another embodiment where ridges 20 are disposed, not completely surrounding cable jacket 18, but rather as partial arcs, around jacket 18 (i.e. covering about ¼ to ⅓ of circumference of jacket 18). The partial arc ridges 20 are disposed randomly about the outer surface of jacket 18, perpendicular to the longitudinal axis of cable 10, but at random intervals as shown in FIG. 5. The spacing and location of the arc ridges 20 are such so that when jacket 18 is arranged next to a jacket 18 of an adjacent cable 10 they allow for airflow there between as described in more detail below. FIG. 6 shows an alternative arrangement with valleys 22 disposed around jacket 18 in a similar arrangement as ridges 20 as shown in FIG. 5 and as described above. FIG. 7 shows another alternative arrangement with both ridges 20 and valleys 22 disposed around the same jacket 18, for example in an alternating fashion, in a similar arrangement as shown in FIGS. 5 and 6.

In each arrangement, ridges 20 or valleys 22 are arranged perpendicular to the longitudinal axis of cable 10 and are spaced apart in a manner that is sufficient to generate the desired air passages between cables 10, when arranged next to other cables, and are otherwise structured and spaced so that either ridges 20 or valleys 22 of jacket 18 do not deform under the weight of the cable itself or allow for the desired air passages to close.

In one embodiment ridges 20 are ideally constructed to a thickness of approximately 50%-100% of the thickness of jacket 18. Valleys 22 are ideally approximately 50% of the thickness of jacket 18. The shape of ridges 20 and/or valleys 22 are not critical (e.g. can be triangular, squared, irregular etc. . . . ) as long as they create the desired air pathways between jackets 18 of adjacently arranged and abutting cables.

In one embodiment, ridges 20 and valleys 22 can be made from a rotating drum that is located closely after jacket 18 is extruded onto cable 10. Such a drum would have its own ridges or cutters that would imprint/cut such ridges 20/valleys 22 into jacket 18 while jacket 18 is still warm and malleable (semi-molten). In another embodiment, to forms ridges 20, a second extruder head can be aligned after the primary jacket 18 extruder so that a "surge" of additional material can be periodically applied onto the still hot jacket 18. In a third possibility, ridges 20 or valleys 22 can be formed after jacket 18 is cooled, in an additional step where ridges 20 can be applied/deposited, or valleys 22 cut, independent from the primary jacket extrusion process.

Figure 8:
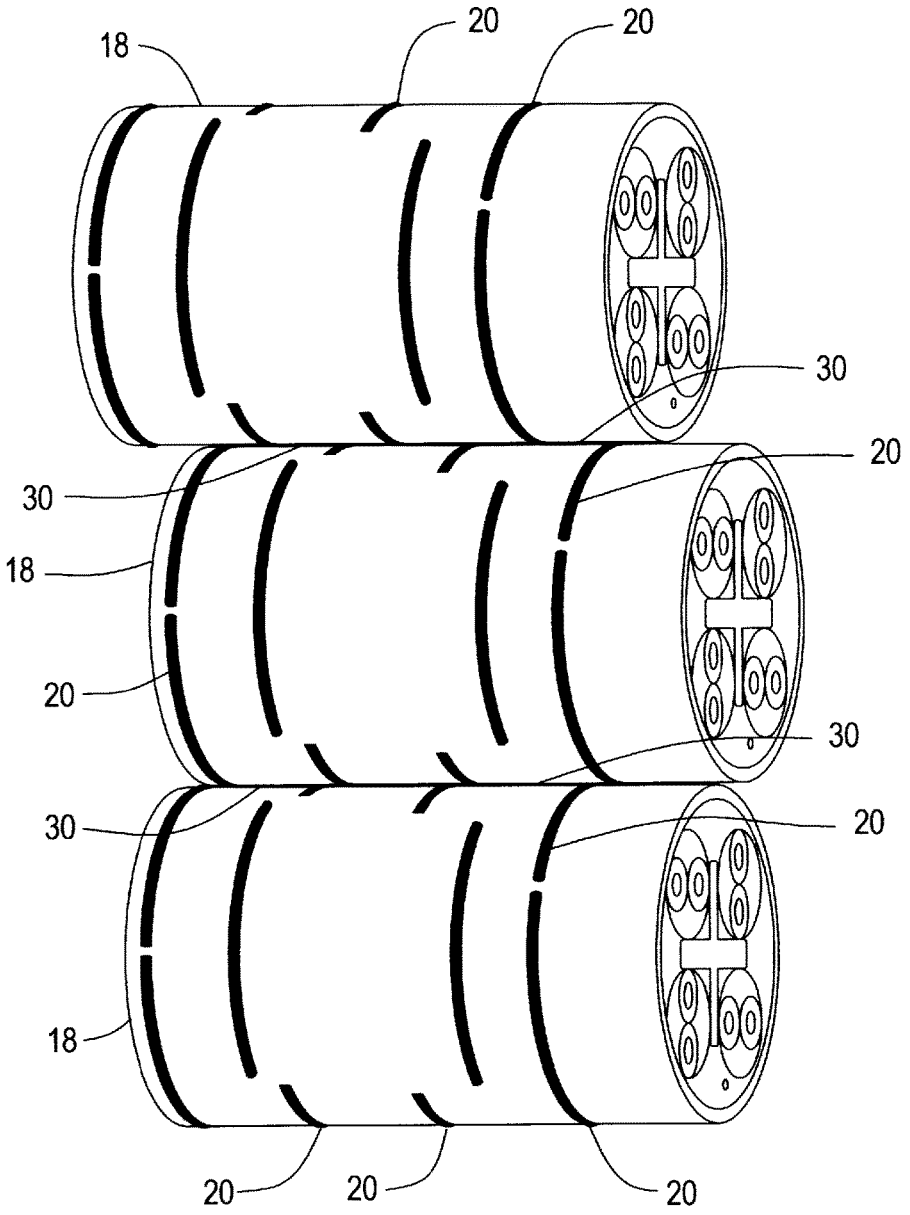
FIG. 8 illustrates a plurality of LAN cables, arranged adjacent to and abutting each other, each having a plurality of ridges disposed on the outer circumference of the jacket, according to one embodiment.

To illustrate the desired effect of the present arrangement, FIG. 8 shows three adjacently arranged cables 10, each having ridges 20 (as partial arcs) around jacket 18 as per FIG. 5. Such ridges 20 generate air gaps 30 between the outer surfaces of jackets 18 of adjacent cables 10. This allows air to flow between jackets 18 via gaps 30, allowing the heat released from the one or more powered twisted pairs to dissipate from adjacent cables 10.

Once such heat is able to pass through jacket 18, it can more easily escape the cable bundle as the heat can move upward through gaps 30 between cables 10. The rising heat in turn draws cool air upwards by convection for further cooling. Air gaps 30 formed by ridges 20 essentially create vertical 'chimneys' as defined by the non-contacting surfaces of adjacent cables 10.

These convection pathways allow for warm air to exit upwards and draw cool air into the cable 10 bundle. It is further noted that, generally speaking, shielded cables generally dissipate heat better than UTP (Unshielded twisted pair) cables. However, shields or tapes add weight and cost to the overall cable design. In some cases where the LAN cable is to be used for tandem power/data communications, installers choose shielded cables, not for their electrical shielding benefits but for their heat dissipation advantage. The present arrangement could mitigate or negate the need to use shields for their heat dissipation properties even though such jackets 18 as described herein would be obviously beneficial for shielded cables as well.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

The invention claimed is:

1. An arrangement of two or more adjacently positioned cables, said cables configured for tandem communication and power transmission, said cable arrangement comprising:

two or more adjacently positioned cables configured for tandem communication and power transmission, each cable having:

a plurality of twisted pair conductors;

at least one power transmission conductor; and a jacket surrounding said twisted pair conductors, wherein said jacket includes a plurality of ridges disposed perpendicular to the longitudinal axis of said cable said ridges dimensioned and spaced apart in a manner sufficient to create a plurality of spaced apart air passages between said adjacent cables, said air passages being perpendicular to the longitudinal axes of said adjacent cables.

2. The cable arrangement as claimed in claim 1, wherein said cable has four twisted pair conductors.

3. The cable arrangement as claimed in claim 1, wherein said jacket is a polymer jacket.

4. The cable arrangement as claimed in claim 1, wherein said ridges extend from the surface of said jacket substantially 50%-100% of a thickness of said jacket.

5. The cable arrangement as claimed in claim 1, wherein said ridges are formed on said jacket as additional material deposited onto said jacket directly after extrusion when said jacket is in a semi-molten state.

6. The cable arrangement as claimed in claim 1, wherein said ridges are formed on said jacket as an additional material of jacket polymer surged periodically during the extrusion of said jacket.

7. The cable arrangement as claimed in claim 1, wherein said ridges are formed independently of said jacket in a second stage after said jacket is extruded and cooled.

8. The cable arrangement as claimed in claim 1, wherein said ridges are disposed as spaced apart ridges, each extending entirely around the circumference of said jacket, substantially perpendicular to the longitudinal axis of said cable.

9. The cable arrangement as claimed in claim 1, wherein said ridges are disposed as spaced apart ridges, each extending part way around the circumference of said jacket in partial arcs, substantially perpendicular to the longitudinal axis of said cable.

10. An arrangement of two or more adjacently positioned cables, said cables configured for tandem communication and power transmission, said cable arrangement comprising:

two or more adjacently positioned cables configured for tandem communication and power transmission, each cable having a plurality of twisted pair conductors;

at least one power transmission conductor; and a jacket surrounding said twisted pair conductors, wherein said jacket includes a plurality of valleys disposed perpendicular to the longitudinal axis of said cable said valleys dimensioned and spaced apart in a manner sufficient to create a plurality of spaced apart air passages between said adjacent cables, said air passages being perpendicular to the longitudinal axes of said cables.

11. The arrangement cable as claimed in claim 10, wherein said cable has four twisted pair conductors.

12. The arrangement cable as claimed in claim 10, wherein said jacket is a polymer jacket.

13. The arrangement cable as claimed in claim 10, wherein said valleys are cut into the surface of said jacket substantially 50% of a thickness of said jacket.

14. The arrangement cable as claimed in claim 10, wherein said valleys are cut into said jacket directly after extrusion when said jacket is in a molten state.

15. The arrangement cable as claimed in claim 10, wherein said valleys formed on said jacket are cut after said jacket is extruded and cooled.

16. The arrangement cable as claimed in claim 10, wherein said valleys are disposed as spaced apart valleys, each extending entirely around the circumference of said jacket, substantially perpendicular to the longitudinal axis of said cable.

17. The arrangement cable as claimed in claim 10, wherein said valleys are disposed as spaced apart valleys, each extending part way around the circumference of said jacket in partial arcs, substantially perpendicular to the longitudinal axis of said cable.

18. An arrangement of two or more adjacently positioned cables, said cables configured for tandem communication and power transmission, said cable arrangement comprising:

two or more adjacently positioned cables configured for tandem communication and power transmission, each cable having:

a plurality of twisted pair conductors;

at least one power transmission conductor; and a jacket surrounding said twisted pair conductors, wherein said jacket includes a plurality of ridges and valleys disposed perpendicular to the longitudinal axis of said cable said ridges and valleys dimensioned and spaced apart in a manner sufficient to create a plurality of spaced apart air passages between said adjacent cables, said air passages being perpendicular to the longitudinal axes of said when said cable is arranged adjacent to and abutting other cables.

* * * * *